US008366406B2

(12) United States Patent
Sato et al.

(10) Patent No.: US 8,366,406 B2
(45) Date of Patent: Feb. 5, 2013

(54) MULTI-STAGE COMPRESSOR

(75) Inventors: Hajime Sato, Aichi (JP); Yoshiyuki Kimata, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 772 days.

(21) Appl. No.: 12/516,667

(22) PCT Filed: Jul. 24, 2008

(86) PCT No.: PCT/JP2008/063236

§ 371 (c)(1),
(2), (4) Date: Aug. 13, 2009

(87) PCT Pub. No.: WO2009/014161

PCT Pub. Date: Jan. 29, 2009

(65) Prior Publication Data

US 2010/0064707 A1 Mar. 18, 2010

(30) Foreign Application Priority Data

Jul. 25, 2007 (JP) ..... 2007-193589

(51) Int. Cl.
*F04B 25/00* (2006.01)
*F25D 17/04* (2006.01)
*F25D 1/10* (2006.01)

(52) U.S. Cl. ..... 417/250; 417/253; 417/278; 62/176.1; 62/510

(58) Field of Classification Search ..... 417/250, 417/253, 205, 278; 62/176.3, 196.2, 510; 418/3, 9

See application file for complete search history.

(56) References Cited

U.S. PATENT DOCUMENTS 5,094,085 A * 3/1992 Irino ..... 62/175
5,345,785 A * 9/1994 Sekigami et al. ..... 62/468

(Continued)

FOREIGN PATENT DOCUMENTS

JP 50-142511 U 11/1975
JP 5-087074 A 4/1993

(Continued)

OTHER PUBLICATIONS

Japanese Office Action dated May 24, 2011, issued in corresponding Japanese Patent Application No. 2007-193589.

(Continued)

*Primary Examiner* — Charles Freay
*Assistant Examiner* — Alexander Comley
(74) *Attorney, Agent, or Firm* — Westerman, Hattori, Daniels & Adrian, LLP

(57) ABSTRACT

A multi-stage compressor is provided that reliably prevents liquid compression in a higher stage compression mechanism and also prevents compression efficiency degradation resulting from overheating of injection refrigerant and from the lubricating oil being raised up together with the injection refrigerant. An injection circuit is branched into a plurality of circuits. A first circuit thereof is communicatively connected to an inside space of a closed housing that is at the same side as the higher stage compression mechanism with respect to an electric motor, and a second circuit is communicatively connected to an inside space of the closed housing that is opposite from the higher stage compression mechanism with respect to the electric motor. The first circuit and the second circuit are provided with a switching mechanism for switching the injection circuit to the first circuit or the second circuit according to the dryness of the injection refrigerant.

7 Claims, 2 Drawing Sheets

U.S. PATENT DOCUMENTS

| | | | | |
|---|---|---|---|---|
| 6,449,972 | B2 * | 9/2002 | Pham et al. | 62/228.3 |
| 2006/0078451 | A1 * | 4/2006 | Kim et al. | 418/55.3 |
| 2008/0173129 | A1 * | 7/2008 | Sato et al. | 74/570.1 |
| 2008/0236184 | A1 * | 10/2008 | Morozumi et al. | 62/324.6 |

FOREIGN PATENT DOCUMENTS

| | | | |
|---|---|---|---|
| JP | 9-236092 | A | 9/1997 |
| JP | 2000-73974 | A | 3/2000 |

OTHER PUBLICATIONS

International Search Report of PCT/JP2008/063236, date of mailing Oct. 21, 2008.

* cited by examiner

MULTI-STAGE COMPRESSOR

TECHNICAL FIELD

The present invention relates to a multi-stage compressor in which a lower stage compression mechanism and a higher stage compression mechanism are provided in a closed housing.

BACKGROUND ART

Various types of multi-stage compressors for use in an air conditioning apparatus have been proposed. One such known multi-stage compressor has a configuration as described below. A lower stage rotary compression mechanism is installed below an electric motor installed at a central portion of a closed housing. The compressed gas is discharged into the closed housing, and this intermediate pressure gas is sucked into a higher stage scroll compression mechanism installed above the electric motor. Thereby, two-stage compression is performed. (For example, see Patent Citation 1.)

Patent Citation 2 proposes a multi-stage compressor as set forth below. An electric motor, a lower stage rotary compression mechanism and a higher stage rotary compression mechanism are installed in a closed housing. An intermediate pressure gas compressed by the lower stage rotary compression mechanism is discharged into a second closed chamber provided in the closed housing, and at the same time, the intermediate pressure gas extracted from a refrigerant circuit side is injected into the second closed chamber, so that this intermediate pressure injection gas and the intermediate pressure gas compressed by the lower stage rotary compression mechanism are mixed together. The mixed gas is sucked by the higher stage rotary compression mechanism, whereby two-stage compression is carried out.

In the multi-stage compressors disclosed in Patent Citations 1 and 2, the interior of the closed housing is made an intermediate pressure chamber, or a portion of the closed housing is partitioned to form an intermediate pressure chamber. The intermediate pressure refrigerant compressed by the lower stage compression mechanism is discharged into the intermediate pressure chamber, and at the same time, the intermediate pressure refrigerant extracted from the refrigerant circuit is injected into the intermediate pressure chamber. This intermediate pressure refrigerant is sucked by the higher stage compression mechanism, so that two-stage compression is performed.

Patent Citation 1: Japanese Unexamined Patent Application, Publication No. 5-87074

Patent Citation 2: Japanese Unexamined Patent Application, Publication No. 2000-54975

DISCLOSURE OF INVENTION

However, the multi-stage compressors disclosed in Patent Citations 1 and 2 have the problem that, when the dryness of the refrigerant injected into the intermediate pressure chamber in the closed housing is low, liquid refrigerant may be sucked into the higher stage compression mechanism, and consequently, liquid compression may occur. In addition, depending on the location of the injection, the injection refrigerant may be overheated by the electric motor, or a pressure loss may occur before the injection refrigerant is sucked into the higher stage compression mechanism. Consequently, the higher stage compression mechanism may suffer from suction efficiency degradation, resulting in compression efficiency degradation. Furthermore, another problem is that the lubricating oil that flows down from the top along the inner circumferential surface of the closed housing is raised up together with the injected refrigerant and discharged from the compressor along with the refrigerant. This causes problems such as increase in the oil circulation ratio.

The present invention has been accomplished in view of the foregoing circumstances, and it is an object of the invention to provide a multi-stage compressor employing an injection mechanism, that can prevent liquid compression in the higher stage compression mechanism reliably and also can prevent compression efficiency degradation resulting from the overheating of the injection refrigerant and the lubricating oil together being raised up together with the injection refrigerant.

In order to solve the foregoing problems, a multi-stage compressor of the invention adopts the following means.

A multi-stage compressor according to one aspect of the invention comprises: a lower stage compression mechanism and a higher stage compression mechanism that are provided in a closed housing and driven by an electric motor, wherein an intermediate pressure refrigerant gas compressed by the lower stage compression mechanism is discharged into the closed housing and the intermediate pressure refrigerant gas is sucked by the higher stage compression mechanism, thus performing two-stage compression, and an injection circuit for injecting an intermediate pressure refrigerant extracted from a refrigerant circuit is provided in the closed housing, the multi-stage compressor characterized in that: the injection circuit is branched into a plurality of circuits, a first circuit which is communicatively connected, to an inside space of the closed housing that is at the same side as the higher stage compression mechanism with respect to the electric motor, and a second circuit which is communicatively connected to an inside space of the closed housing that is opposite from the higher stage compression mechanism with respect to the electric motor; and the first circuit and the second circuit are provided with a switching mechanism for switching the injection flow to either the first circuit or the second circuit according to the dryness of the injection refrigerant.

According to the present invention, the injection flow may be switched to either to the first circuit or the second circuit by the switching mechanism according to the dryness of the refrigerant to be injected, so that the refrigerant to be injected into the closed housing can be injected into either the inside space of the closed housing that is at the same side as the higher stage compression mechanism or the inside space of the closed housing that is opposite from the higher stage compression mechanism with respect to the electric motor. Thus, when the dryness of the injection refrigerant becomes low and there is a possibility that liquid compression may occur in the higher stage compression mechanism, such as when starting or when the pressure changes suddenly (transition period), the injection refrigerant is injected through the second circuit into the inside space of the closed housing that is opposite from the higher stage compression mechanism with respect to the electric motor so that the liquid refrigerant can be evaporated by the heat generated by the electric motor. Thereby, liquid compression in the higher stage compression mechanism can be prevented, and at the same time, the electric motor is cooled by the refrigerant so the motor efficiency can be improved. On the other hand, when the dryness of the injection refrigerant is high, the injection refrigerant is injected through the first circuit into the inside space of the closed housing that is at the same side as the higher stage compression mechanism so that the injection refrigerant can be sucked into the higher stage compression mechanism as it is. As a result, the overheating of the injection refrigerant by the electric motor can be avoided so that suction efficiency degradation of the higher stage compression mechanism can be prevented and compression efficiency can be increased. At the same time, the lubricating oil held in the closed housing can kept from being raised together with the injection refrigerant, so that the oil circulation ratio is reduced and the system efficiency can be enhanced.

In the above-described multi-stage compressor, it is possible to employ a configuration in which the switching mechanism switches the injection circuit to the first circuit when the dryness is equal to or greater than a predetermined value, and the switching mechanism switches the injection circuit to the second circuit when the dryness is equal to or less than the predetermined value.

According to this configuration, the injection circuit can be switched to the first circuit by the switching mechanism when the dryness of the injection refrigerant is equal to or greater than a predetermined value. In this case, the injection refrigerant can be injected into the inside space of the closed housing that is at the same side as the higher stage compression mechanism, and the injection refrigerant is taken into the higher stage compression mechanism as is. On the other hand, the injection flow can be switched to the second circuit when the dryness of the injection refrigerant is equal to or less than the predetermined value. In this case, the injection refrigerant can be injected into the inside space of the closed housing that is opposite from the higher stage compression mechanism with regard to the electric motor. The injection refrigerant is turned into an evaporated gas by the heat generated by the electric motor and thereafter it is taken into the higher stage compression mechanism. Therefore, in the case where the dryness of the injection refrigerant is large and there is no risk of liquid compression, overheating of the injection refrigerant due to the electric motor can be prevented, and compression efficiency can be improved. At the same time, the lubricating oil can be prevented from being raised up together with the injection refrigerant, so that the oil circulation ratio can be suppressed and the system efficiency can be enhanced. On the other hand, in the case where the dryness of the injection refrigerant is low and there is a risk of liquid compression, such liquid compression can be prevented reliably, and at the same time, the electric motor can be cooled so that motor efficiency can be improved.

In any one of the above-described multi-stage compressors, it is possible to employ a configuration wherein: the electric motor is disposed at a substantially central portion of the closed housing, a rotary compression mechanism that constitutes the lower stage compression mechanism and a scroll compression mechanism that constitutes the higher stage compression mechanism are disposed below and above the electric motor, respectively, and the first circuit is communicatively connected to the inside space of the closed housing above the electric motor, and the second circuit is communicatively connected to the inside space of the closed housing below the electric motor.

According to this configuration, the lower stage is a rotary compression mechanism and the higher stage is a scroll compression mechanism. Since the higher stage compression mechanism is a scroll compression mechanism, which has less compression leakage than a rotary compression mechanism when there is high pressure difference, the compression efficiency of the higher stage compression mechanism can be increased, and performance of the multi-stage compressor can be improved as much as practicably possible. Moreover, the first circuit of the injection circuit is communicatively connected to the inside space of the closed housing above the electric motor, and the second circuit is communicatively connected to the inside space of the closed housing below the electric motor. Therefore, when the dryness of the injection refrigerant is equal to or greater than a predetermined value, overheating of the injection refrigerant by the electric motor can be prevented, so that the compression efficiency can be improved, and at the same time, the lubricating oil can be prevented from being raised up together with the injection refrigerant, so that the oil circulation ratio can be suppressed and the system efficiency can be enhanced. On the other hand, when the dryness of the injection refrigerant is equal to or less than the predetermined value, the occurrence of liquid compression can be prevented reliably, and at the same time, the electric motor can be cooled so that motor efficiency can be improved.

In any one of the above-described multi-stage compressors, it is possible to employ a configuration wherein: the electric motor is disposed in an upper portion of the closed housing, and a lower stage rotary compression mechanism that constitutes the lower stage compression mechanism and a higher stage rotary compression mechanism that constitutes the higher stage compression mechanism are both disposed below the electric motor; and the first circuit is communicatively connected to the inside space of the closed housing below the electric motor, and the second circuit is communicatively connected to the inside space of the closed housing above the electric motor.

According to this configuration, both the lower stage compression mechanism and the higher stage compression mechanism comprise rotary compression mechanisms, and they are disposed below the electric motor in the closed housing that is brought to an intermediate pressure atmosphere. Therefore, internal leakage can be suppressed by making the pressure difference between the compression mechanisms and the inside of the closed housing smaller, and at the same time, size reduction of the compressor is achieved by reducing the vertical dimensions of the compressor. Moreover, the first circuit of the injection circuit is communicatively connected, to the inside space of the closed housing below the electric motor, and the second circuit is communicatively connected to the inside space of the closed housing above the electric motor. Therefore, when the dryness of the injection refrigerant is equal to or greater than a predetermined value, overheating of the injection refrigerant by the electric motor can be prevented, so that the compression efficiency can be improved, and at the same time, the lubricating oil can be prevented from being raised up together with the injection refrigerant, so that the oil circulation ratio can be suppressed and the system efficiency can be enhanced. On the other hand, when the dryness of the injection refrigerant is equal to or less than the predetermined value, liquid compression can be prevented reliably, and at the same time, the electric motor can be cooled so that motor efficiency can be improved.

In any one of the above-described multi-stage compressors, it is possible to employ a configuration in which the first circuit or the second circuit, whichever is communicatively connected to the inside space of the closed housing below the electric motor, is connected by an opening portion that protrudes from the inner circumferential surface of the closed housing toward the center.

According to this configuration, the opening portion at the closed housing of either the first circuit or the second circuit, whichever is communicatively connected to the inside space of the closed housing below the electric motor, protrudes toward the center from the inner circumferential surface of the closed housing. Therefore, it is possible to prevent the lubricating oil flowing down from above along the inner circumferential surface of the closed housing to be raised up together with the compression gas. Thereby, the oil circulation ratio can be suppressed, and the system efficiency can be enhanced.

In the foregoing multi-stage compressor, it is possible to employ a configuration in which the amount of protrusion of the opening portion is greater than the width of a stator cut of the electric motor in the radial direction from the outer circumference.

According to this configuration, the protrusion amount of the opening portion is made greater than the width of a stator cut of the electric motor in the radial direction from the outer circumference. Therefore, the refrigerant can be injected without the lubricating oil flowing down through the stator cut along the inner circumferential surface of the closed housing rising up together with the injection refrigerant, in a reliable manner. As a result, the oil circulation ratio can be suppressed effectively, and the system efficiency can be enhanced.

In any one of the above-described multi-stage compressors, it is possible to employ a configuration in which an opening portion of the first circuit projecting to the inside of the closed housing is provided near a suction port of the higher stage compression mechanism.

According to this configuration, the opening portion of the first circuit to the closed housing is provided near the suction port of the higher stage compression mechanism. Therefore, the injected refrigerant can be sucked into the higher stage compression mechanism while minimizing the overheating and pressure loss of the injected refrigerant in the closed housing. As a result, the suction efficiency degradation of the higher stage compression mechanism can be prevented, and the compression efficiency can be enhanced.

The present invention can prevent liquid compression in the higher stage compression mechanism and at the same time can improve motor efficiency by cooling the electric motor with the refrigerant. Moreover, overheating of the injection refrigerant by the electric motor is inhibited, and suction efficiency degradation of the higher stage compression mechanism is prevented, whereby compression efficiency can be enhanced. Furthermore, the lubricating oil is prevented from rising up together with the injection refrigerant, so that the oil circulation ratio can be kept low, and the system efficiency can be enhanced.

EXPLANATION OF REFERENCE

Figure 1:
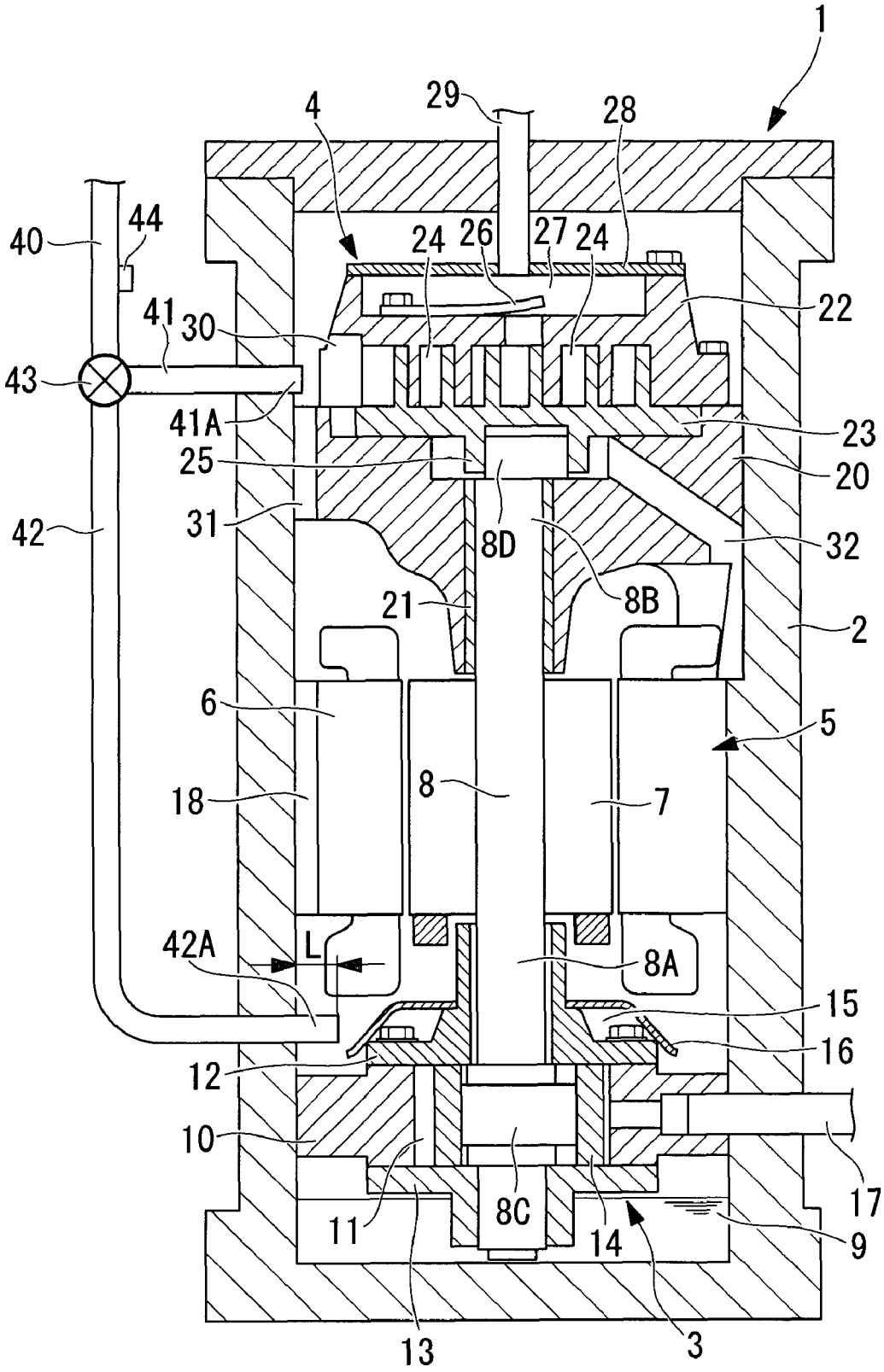
FIG. 1 is a vertical cross-sectional view of a multi-stage compressor according to a first embodiment of the invention.

1: multi-stage compressor
2: closed housing
3: lower stage compression mechanism (lower stage rotary compression mechanism)
4: higher stage compression mechanism (higher stage scroll compression mechanism)
4A: higher stage compression mechanism (higher stage rotary compression mechanism)
5: electric motor
6: stator
18: stator cut
30: suction port
40: injection circuit
41: first circuit
41A: opening portion of first circuit
42: second circuit
42A: opening portion of second circuit
43: switching valve (switching mechanism)
44: dryness detection means

BEST MODE FOR CARRYING OUT THE INVENTION

Hereinbelow, preferred embodiments of the invention will be described with reference to the drawings.

First Embodiment

Hereinbelow, a first embodiment of the invention will be described with reference to FIG. 1.

FIG. 1 shows a vertical cross-sectional view of a multi-stage compressor 1 according to a first embodiment of the invention. This multi-stage compressor 1 is configured such that a lower stage compression mechanism 3 is installed in the lower portion of a closed housing 2 and a higher stage compression mechanism 4 is installed in the upper portion of the closed housing 2. An electric motor 5 having a stator 6 and a rotor 7 is provided at a central portion of the closed housing 2, and a crank shaft 8 is coupled integrally to the rotor 7. The lower end portion of the crank shaft 8 is formed to be the crank shaft 8A for the lower stage compression mechanism 3, while the upper end portion of the crank shaft 8 is formed to be the crank shaft 8B for the higher stage compression mechanism 4.

A predetermined amount of lubricating oil 9 is enclosed in the bottom part of the closed housing 2. The lubricating oil 9 is sucked up by an oil supply pump, not shown in the drawings, that is provided at the lower end portion of the crank shaft 8, is then passed through an oil supply port, not shown in the drawings, that is formed in the crank shaft 8 in the axial direction thereof, and is supplied to the locations of the lower stage compression mechanism 3 and the higher stage compression mechanism 4 that need lubricating.

The lower stage compression mechanism 3 comprises a rotary compression mechanism. The lower stage rotary compression mechanism 3 may be a common rotary compression mechanism, which has a cylinder chamber 11, a cylinder main unit 10 that is fixed in the closed housing 2, an upper bearing 12 and a lower bearing 13 that are respectively installed above and below the cylinder main unit 10, a rotor 14 that is fitted into a crank portion 8C of the crank shaft 8A and is rotated in the cylinder chamber 11, a discharge cover 16 that forms a discharge cavity 15, a blade and a blade retaining spring (not shown in the drawings), and so forth.

In the lower stage rotary compression mechanism 3, the refrigerant gas sucked into the cylinder chamber 11 via a suction pipe 17, which is connected to an accumulator, not shown, is compressed to an intermediate pressure by rotation of the rotor 14. Thereafter, the refrigerant gas is discharged into the discharge cavity 15 and further discharged into the closed housing 2 through a discharge opening provided in the discharge cover 16. The intermediate pressure refrigerant gas discharged into the closed housing 2 flows to an upper space of the closed housing 2 through an air gap in the electric motor 5 and through stator cuts 18 provided at several locations along the outer circumference of the stator 6. Then, the refrigerant gas is sucked into the higher stage compression mechanism 4.

The higher stage compression mechanism 4 comprises a scroll compression mechanism. The higher stage scroll compression mechanism 4 may be a common scroll compression mechanism, which comprises a frame member 20, a stationary scroll 22, an orbiting scroll 23, a rotating boss portion 25, a self-rotation prevention mechanism (not shown in the drawings), a discharge valve 26, and a discharge cover 28, for example. The frame member 20 has a bush bearing 21 for supporting the crank shaft 8B, and is securely installed in the closed housing 2. The stationary scroll 22 and the orbiting scroll 23, supported on the frame member 20, mesh with each other in such a manner that their phases are displaced from each other, and they form a pair of compression chambers 24. The scroll boss portion 25 connects the rotating scroll 23 to a crankpin 8D provided at an end of the crank shaft 8B and makes the revolving scroll 23 rotate. The self-rotation prevention mechanism, provided between the rotating scroll 23 and the frame member 20, prevents the rotating scroll 23 from rotating about itself but allows it to revolve while rotating. The discharge valve 26 is provided on a back surface of the stationary scroll 22. The discharge cover 28, fixed on the back surface of the stationary scroll 22, forms a discharge chamber 27 between it and the stationary scroll 22.

In the higher stage scroll compression mechanism 4, a discharge pipe 29 is connected to the discharge chamber 27 so that the refrigerant gas compressed to a high temperature and a high pressure by two-stage compression can be guided to the outside of the compressor. In the higher stage scroll compression mechanism 4, an intermediate pressure refrigerant gas that is compressed to an intermediate pressure by the lower stage rotary compression mechanism 3 and discharged into the closed housing 2 and an intermediate pressure refrigerant injected into the closed housing 2 via a later-described injection circuit 40 are mixed together in the closed housing 2. Thereafter, they are sucked into a pair of compression chambers 24 through a suction port 30.

Because the rotating scroll 23 is driven so as to revolve while rotating, the pair of compression chambers 24 are gradually moved toward the center while their volume is gradually reduced, and finally the pair of compression chambers 24 are merged with each other to form one compression chamber 24. During this period, the refrigerant gas is compressed from the intermediate pressure to a high pressure (discharge pressure), and is discharged from a center portion of the stationary scroll 22 via the discharge valve 26 into the discharge chamber 27. This high-temperature and high-pressure refrigerant gas is guided to the outside of the multi-stage compressor 1 through the discharge pipe 29. The frame member 20 of the higher stage scroll compression mechanism 4 is provided with a refrigerant passage 31 for guiding the intermediate pressure refrigerant compressed in the lower stage rotary compression mechanism 3 to the suction port 30. The frame member 20 is also provided with an oil return port 32 for returning the lubricating oil 9 that has lubricated the higher stage scroll compression mechanism 4 to the bottom part of the closed housing 2.

The injection circuit 40 for injecting the intermediate pressure refrigerant (gas refrigerant or liquid refrigerant) extracted from the refrigerant circuit into the closed housing 2 that is at an intermediate pressure is connected to the multi-stage compressor 1. The injection circuit 40 is branched into two circuits, a first circuit 41 and a second circuit 42, in the vicinity of the compressor. One of the branched circuits, the first circuit 41, is communicatively connected to an inside space of the closed housing 2 that is at the side of the electric motor 5 in which the higher stage scroll compression mechanism 4 is installed, in other words, an inside space of the closed housing 2 that is above the electric motor 5.

Desirably, the first circuit 41 is connected to the closed housing 2 near or above the suction port 30 of the higher stage scroll compression mechanism 4. In other words, the first circuit 41 is connected to the closed housing 2 so that the entirety of or a portion of the outlet opening portion 41A of the first circuit 41 leading into the inside of the closed housing 2 is facing or located above the suction port 30, at a position along the circumference and/or the axis of the closed housing 2.

On the other hand, the other branch circuit, the second circuit 42, is communicatively connected to an inside space of the closed housing 2 that is at the opposite side from the side in which the higher stage scroll compression mechanism 4 is installed with regard to the electric motor 5, in other words, an inside space of the closed housing 2 that is below the electric motor 5. The second circuit 42 is connected to the closed housing 2 so that the outlet opening portion 42A entering the inside of the closed housing 2 protrudes from the inner circumferential surface of the closed housing 2 toward the center, and the protrusion amount L thereof is made greater than the width in the radial direction of the stator cuts 18 provided in the outer circumference of the stator 6 of the electric motor 5. It is desirable that the circumferential location at which the first circuit 41 and the second circuit 42 are connected should be as distant as possible from the location of the oil return port 32.

In addition, a switching valve (switching mechanism) 43 for switching the injection circuit 40 to either the first circuit 41 or the second circuit 42 is provided at the branch portion where the first circuit 41 and the second circuit 42 branch apart. The switching valve 43 is switched according to the dryness of the injection refrigerant, which is detected by a dryness detection means 44. The refrigerant is connected to the first circuit 41 when operation conditions are normal and the dryness of the refrigerant is greater than a predetermined value, while the refrigerant is switched over to the second circuit 42 when the dryness of the refrigerant is equal to or less than the predetermined value. The dryness detection means 44 may have any configuration and may be include a temperature sensor, a pressure sensor, or the like. In particular, the temperature sensor does not need to be provided in the injection circuit 40, and it is possible to use a detected value obtained by a temperature sensor, not shown in the drawings, provided at the bottom part of the closed housing 2 or in the vicinity of the branch portion of the injection circuit 40 leading from the refrigerant circuit.

Hereinbelow, the operation of the multi-stage compressor 1 will be explained.

A low pressure refrigerant gas is sucked directly into the cylinder chamber 11 of the lower stage rotary compression mechanism 3 of the multi-stage compressor 1 through the suction pipe 17. This refrigerant gas is compressed to an intermediate pressure by the rotor 14 rotated by the electric motor 5 via the crank shaft 8 (8A) and thereafter is discharged to the discharge cavity 15. The refrigerant gas is further passed from the discharge cavity 15 through a discharge opening provided in the discharge cover 16 and is discharged into the closed housing 2. Thereby, the inside of the closed housing 2 is turned into an intermediate pressure atmosphere, and the electric motor 5 and the lubricating oil 9 are brought to approximately the same temperature as that of the intermediate pressure refrigerant.

An intermediate pressure refrigerant (gas refrigerant or liquid refrigerant) extracted from the refrigerant circuit, not shown in the drawings, is injected into the closed housing 2 that has the intermediate pressure atmosphere, through either the first circuit 41 or the second circuit 42 of the injection circuit 40. These intermediate pressure refrigerants are mixed together inside the closed housing 2, and thereafter are sucked into the compression chamber 24 of the higher stage scroll compression mechanism 4 via the suction port 30 formed in the closed housing 2. Here, when the dryness of the refrigerant injected from the injection circuit 40 is equal to or less than a predetermined value, the switching valve 43 is switched over to the second circuit 42. Accordingly, the injection refrigerant is injected through the second circuit 42 to an inside space of the closed housing 2 below the electric motor 5.

The refrigerant with low dryness which is injected through the second circuit 42 into the inside space of the closed housing 2 is mixed with the intermediate pressure refrigerant that is discharged from the lower stage rotary compression mechanism 3. The refrigerant is heated by the heat of the electric motor 5 while it flows upward through the air gap and the stator cuts 18 of the electric motor 5, so the liquid content thereof sufficiently evaporated and gasified. The gasified refrigerant travels through the refrigerant passage 31, reaching the suction port 30 of the higher stage scroll compression mechanism 4, and it is sucked into the higher stage scroll compression mechanism 4.

On the other hand, when the dryness of the refrigerant injected from the injection circuit 40 is equal to or greater than a predetermined value, there is no risk of liquid compression. Accordingly, the refrigerant to be injected is made to pass through the first circuit 41 by the switching valve 43 and is injected at a location near the suction port 30 above the electric motor 5 in the closed housing. As a result, this injection refrigerant is sucked into the higher stage scroll compression mechanism 4 without being overheated by the electric motor 5.

In the higher stage scroll compression mechanism 4, when the electric motor 5 is rotated, the rotating scroll 23 is driven to revolve relative to the stationary scroll 22 while it rotates by the crank shaft 8B and the crankpin 8D, and a compression operation is performed. Thereby, the intermediate pressure refrigerant gas is compressed to a high pressure condition and is discharged via the discharge valve 26 into the discharge chamber 27. The high-temperature and high-pressure refrigerant gas discharged into the discharge chamber 27 is guided from the multi-stage compressor 1 to the refrigerant circuit through the discharge pipe 29 connected to the discharge chamber 27, and is circulated through the refrigerant circuit.

During the above-described compression operation, the lubricating oil 9 filled in the closed housing 2 is supplied to the portions of the lower stage rotary compression mechanism 3 and the higher stage scroll compression mechanism 4 that require oil supply by the oil supply pump, not shown in the drawings, via the oil supply port, so as to lubricate both of the compression mechanisms 3 and 4. A portion of the lubricating oil 9 that has lubricated the compression mechanisms 3 and 4 is circulated to the refrigerant circuit side along with the refrigerant. However, most of the lubricating oil 9 flows from the oil return port 32 and the like, along the inner circumferential surface of the closed housing 2, and down to the bottom part of the closed housing 2 passing through the stator cuts 18 and the like, so that a constant oil level can be maintained.

Hence, the present embodiment exhibits the following advantageous effects.

The injection can be effected by switching the injection circuit 40 to either the first circuit 41 or the second circuit 42 with the switching valve (switching mechanism) 43 according to the dryness of the injection refrigerant detected by the dryness detection means 44. That is, when the dryness of the injection refrigerant becomes less than a predetermined value and there is a possibility that liquid compression may occur in the higher stage scroll compression mechanism 4, such as when starting or when the pressure changes suddenly (transition period), the injection refrigerant can be injected through the second circuit 42 into the inside space of the closed housing 2 that is opposite from the higher stage scroll compression mechanism 4 with regard to the electric motor 5, i.e., below the electric motor 5. In this way, liquid refrigerant can be evaporated by making use of the heat generation of the electric motor 5. As a result, liquid compression in the higher stage scroll compression mechanism 4 can be prevented, and at the same time, motor efficiency can be improved by cooling the electric motor 5 with the refrigerant.

Moreover, the opening portion 42A of the second circuit 42 protrudes toward the center of the closed housing 2 by a length L that is greater than the width of the stator cuts 18 in the radial direction. Therefore, when injecting the refrigerant through the second circuit 42, the lubricating oil 9 flowing down along the inner circumferential surface of the closed housing 2 and through the stator cuts 18 and the like after lubricating the higher stage scroll compression mechanism 4 is prevented from being raised up together with the injection refrigerant. This makes it possible to suppress an increase of the oil circulation ratio that results when the lubricating oil 9 which has been raised up and sucked into the higher stage scroll compression mechanism 4 along with the refrigerant is discharged from the compressor.

Furthermore, when the dryness of the injection refrigerant is equal to or greater than the predetermined value and there is no risk of liquid compression, the injection refrigerant is injected through the first circuit 41 into the inside space of the closed housing 2 that is at the same side as the higher stage scroll compression mechanism 4, i.e., above the electric motor 5, and near the suction port 30. As a result, the injection refrigerant can be sucked into the higher stage scroll compression mechanism 4 as it is. Thus, overheating (mainly overheating caused by the electric motor 5) and pressure loss of the injected refrigerant inside the closed housing 2 can be suppressed, and suction efficiency degradation of the higher stage scroll compression mechanism 4 can be prevented, so the compression efficiency can be enhanced. At the same time, the lubricating oil 9 can be prevented from being raised up together with the injection refrigerant, so that the oil circulation ratio is reduced and the system efficiency can be enhanced.

Furthermore, the higher stage compression mechanism 4 comprises the scroll compression mechanism 4, which has less compression leakage than a rotary compression mechanism when there is a high pressure differential. Therefore, the compression efficiency of the higher stage compression mechanism 4 can be increased, and the performance of the multi-stage compressor 1 can be improved as much as possible. At the same time, the room cooling and heating capacity and the coefficient of performance (COP) can of course be improved by the economizing effect resulting from the refrigerant injection.

Second Embodiment

Figure 2:
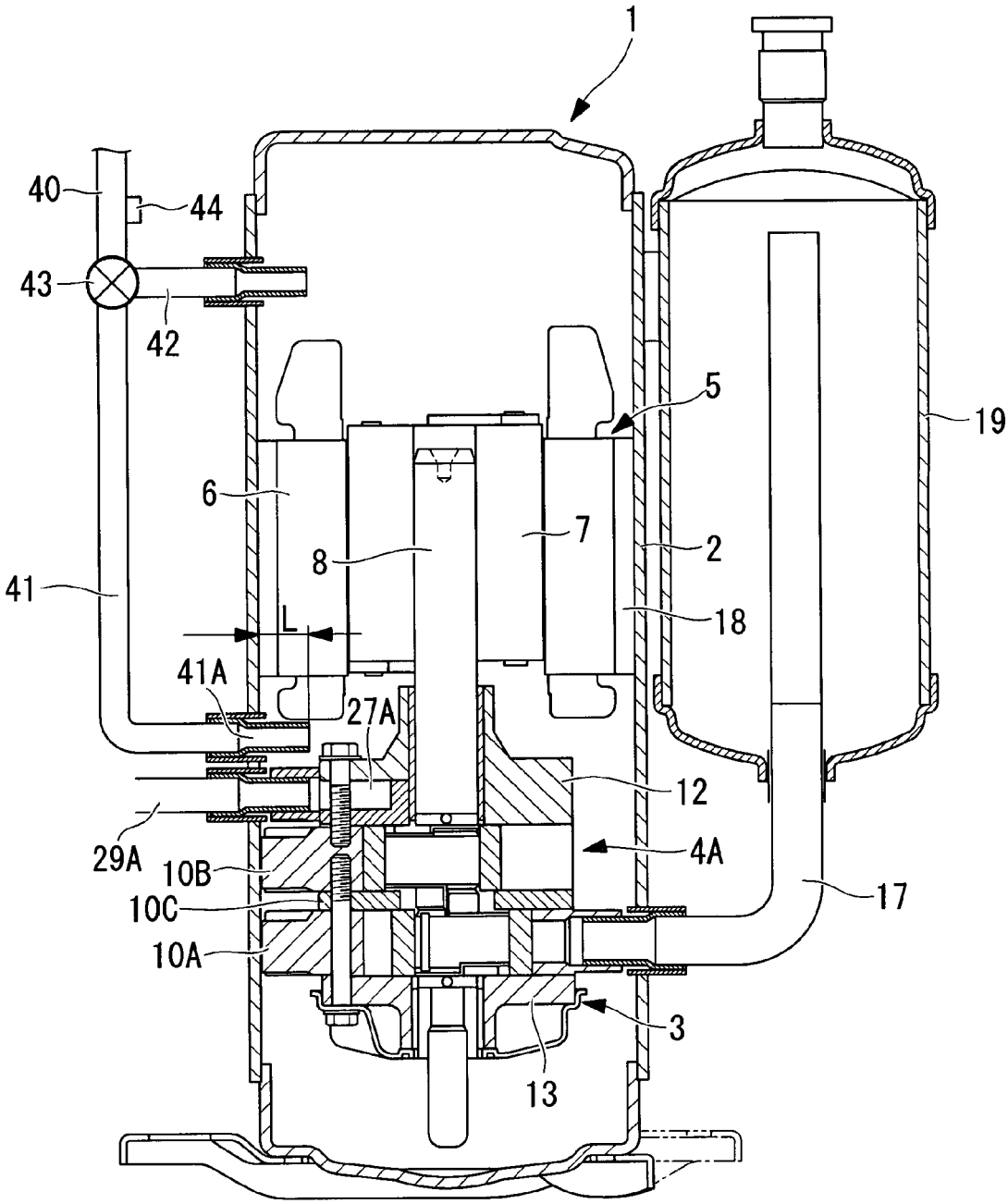
FIG. 2 is a vertical cross-sectional view of a multi-stage compressor according to a second embodiment of the invention.

Next, a second embodiment of the invention will be described with reference to FIG. 2.

The present embodiment differs from the foregoing first embodiment in that both the lower stage compression mechanism 3 and a higher stage compression mechanism 4A comprise rotary compression mechanisms. In other respects, this embodiment is the same as the first embodiment, so the description thereof will be omitted.

In the multi-stage compressor 1 according to this embodiment, the electric motor 5 is installed in an upper portion of the closed housing 2, and the lower stage compression mechanism 3 and the higher stage compression mechanism 4A that are driven by the crank shaft 8 are disposed below the electric motor 5.

Both the lower stage compression mechanism 3 and the higher stage compression mechanism 4A comprise rotary compression mechanisms. The lower stage rotary compression mechanism 3 and the higher stage rotary compression mechanism 4A may have the same configuration as the publicly-known lower stage rotary compression mechanism 3 shown in FIG. 1. A cylinder main unit 10A of the lower stage rotary compression mechanism 3 containing a cylinder chamber and a cylinder main unit 10B of the higher stage rotary compression mechanism 4A containing a cylinder chamber are provided between the upper bearing 12 and the lower bearing 13, and a partition plate 100 is interposed between the cylinder main units 10A and 10B so as to partition the lower stage rotary compression mechanism 3 and the higher stage rotary compression mechanism 4A.

The lower stage rotary compression mechanism 3 has a configuration in which a low pressure refrigerant gas is sucked in from an accumulator 19 through the suction pipe 17 and compressed to an intermediate pressure, and thereafter the intermediate pressure refrigerant gas is discharged into the closed housing 2. In this way, the inside of the closed housing 2 is brought to an intermediate pressure atmosphere. The higher stage rotary compression mechanism 4A has a configuration in which the intermediate pressure refrigerant gas is sucked from the inside of the closed housing 2 and compressed to a high pressure, and thereafter, the refrigerant gas is discharged into a discharge chamber 27A and is further discharged through a discharge pipe 29A to the outside of the multi-stage compressor 1.

In the multi-stage compressor 1, the injection circuit 40 for injecting the refrigerant (gas refrigerant or liquid refrigerant) extracted from the refrigerant circuit into the closed housing 2 is connected so that the first circuit 41 thereof is communicatively connected to an inside space of the closed housing 2 that is at the same side as the higher stage rotary compression mechanism 4A, i.e., below the electric motor 5. The opening portion 41A of the first circuit 31 is connected to the closed housing 2 so that it protrudes from the inner circumferential surface of the closed housing 2 toward the center, and the protrusion amount L thereof is made greater than the width in the radial direction of the stator cuts 18 provided in the outer circumference of the stator 6 of the electric motor 5.

In addition, the second circuit 42 of the injection circuit 40 is communicatively connected to an inside space of the closed housing 2 that is opposite from the higher stage rotary compression mechanism 4A with respect to the electric motor 5, i.e., above the electric motor 5. It should be noted that, as in the first embodiment, the switching valve 43 is connected to the first circuit 41 side when under the normal operating condition in which the dryness of the refrigerant is greater than a predetermined value, while it is switched over to the second circuit 42 side when the dryness of the refrigerant is equal to or less than the predetermined value.

Thus, in the present embodiment as well as in the above-described first embodiment, when the dryness of the injection refrigerant becomes less than a predetermined value and there is a possibility that liquid compression may occur in the higher stage rotary compression mechanism 4A, such as when starting or when the pressure changes violently (transition period), the injection refrigerant can be injected through the second circuit 42 into the inside space of the closed housing 2 that is opposite from the higher stage rotary compression mechanism 4A with regard to the electric motor 5, i.e., the inside space of the closed housing 2 that is above the electric motor 5. Thereby, the liquid refrigerant can be evaporated by the heat generated by the electric motor 5. As a result, liquid compression in the higher stage rotary compression mechanism 4A can be prevented, and at the same time, motor efficiency can be improved by cooling the electric motor 5 with the refrigerant.

On the other hand, when the dryness of the injection refrigerant is equal to or greater than the predetermined value and there is no risk of liquid compression, the injection refrigerant is injected through the first circuit 41 into the inside space of the closed housing 2 that is at the same side as the higher stage rotary compression mechanism 4A, i.e., below the electric motor 5. As a result, the injection refrigerant can be sucked into the higher stage rotary compression mechanism 4A as is. Thus, overheating (mainly overheating caused by the electric motor 5) and pressure loss of the injected refrigerant in the closed housing 2 can be suppressed, and suction efficiency degradation of the higher stage rotary compression mechanism 4A can be prevented, so the compression efficiency can be enhanced.

Moreover, the opening portion 41A of the first circuit 41 protrudes toward the center of the closed housing 2 by a length L that is greater than the width in the radial direction of the stator cuts 18. Therefore, when the refrigerant is injected through the first circuit 41, the lubricating oil 9 that is separated in the inside space of the closed housing 2 above the motor and flows down along the inner circumferential surface of the closed housing 2 passing through the stator cuts 18 and the like is prevented from being raised up together with the injection refrigerant. This makes it possible to suppress an increase of the oil circulation ratio that results from the discharge from the compressor of lubricating oil 9 which has been raised up and sucked into the higher stage rotary compression mechanism 4A along with the refrigerant.

What is more, in this embodiment, both the lower stage compression mechanism 3 and the higher stage compression mechanism 4 comprise rotary compression mechanisms, and they are disposed below the electric motor 5 in the closed housing that is brought to an intermediate pressure atmosphere. Therefore, the pressure difference between the compression mechanisms 3 and 4A and the inside of the closed housing 2 is made smaller, which suppresses internal leakage, and at the same time, size reduction of the compressor is achieved by reducing the vertical dimensions of the compressor. In addition, the room cooling and heating capacity and the coefficient of performance (COP) can of course be improved by the economizing effect resulting from the refrigerant injection.

It should be noted that the foregoing embodiments are not to be construed to limit the present invention, and that the invention may be modified as appropriate without departing from the scope of the invention. For example, although in the foregoing embodiments, the switching valve (switching mechanism) 43 comprises a three-way switching valve provided at a branch portion, it is of course possible to construct the switching mechanism by providing a solenoid valve for both the first circuit 41 and the second circuit 42. In addition, the refrigerant may be any type of refrigerant.

The invention claimed is:

1. A multi-stage compressor comprising: a lower stage compression mechanism and a higher stage compression mechanism that are provided in a closed housing and driven by an electric motor, wherein an intermediate pressure refrigerant gas which has been compressed by the lower: stage compression mechanism is discharged into the closed housing, and the intermediate pressure refrigerant gas is sucked into the higher stage compression mechanism, thus performing two-stage compression, and an injection circuit for injecting an intermediate pressure refrigerant extracted from a refrigerant circuit into the closed housing is provided, the multi-stage compressor characterized in that: the injection circuit is branched into a plurality of circuits, a first circuit thereof being communicatively connected to an inside space of the closed housing that is at a same side as the higher stage compression mechanism with respect to the electric motor, and a second circuit being communicatively connected to an inside space of the closed housing that is opposite from the higher stage compression mechanism with respect to the electric motor; and the first circuit and the second circuit are provided with a switching mechanism for switching the injection circuit to either the first circuit or the second circuit according to a dryness of the injection refrigerant.

2. The multi-stage compressor as set forth in claim 1, characterized in that the switching mechanism switches the injection circuit to the first circuit when the dryness is equal to or greater than a predetermined value, and the switching mechanism switches the injection circuit to the: second circuit when the dryness is equal to or less than the predetermined value.

3. The multi-stage compressor as set forth in claim 1, characterized in that: the electric motor is disposed at a substantially central portion of the closed housing, and a rotary compression mechanism that constitutes the lower stage compression mechanism and a scroll compression mechanism that constitutes the higher stage compression mechanism are disposed respectively below and above the electric motor; and the first circuit is communicatively connected to the inside space of the closed housing above the electric motor, and the second circuit is communicatively connected to the inside space of the closed housing below the electric motor.

4. The multi-stage compressor as set forth in claim 1, characterized in that: the electric motor is disposed in an upper portion of the closed housing, and a lower stage rotary compression mechanism that constitutes the lower stage compression mechanism and a higher stage rotary compression mechanism that constitutes the higher stage compression mechanism are disposed below the electric motor; and the first circuit is communicatively connected to the inside space of the closed housing below the electric motor, and the second circuit is communicatively connected to the inside space of the closed housing above the electric motor.

5. The multi-stage compressor as set forth in claim 1, characterized in that either the first circuit and the second circuit, whichever is communicatively connected to the inside space of the closed housing below the electric motor, is provided with an opening portion entering the closed housing, the opening portion protruding from an inner circumferential surface of the closed housing toward a center.

6. The multi-stage compressor as set forth in claim 5, characterized in that a protrusion amount of the opening portion is greater than a width in a radial direction of a stator cut provided in an outer circumference of a stator of the electric motor.

7. The multi-stage compressor as set forth in claim 1, characterized in that an opening portion of the first circuit to the inside of the closed housing is provided near a suction port of the higher stage compression mechanism.

* * * * *